US009089228B2

(12) United States Patent
Shattuck et al.

(10) Patent No.: US 9,089,228 B2
(45) Date of Patent: Jul. 28, 2015

(54) SEGMENTED QUILTED BLANKET AND CORRESPONDING MOCK DUVET COVER BED COVERING SYSTEM

(75) Inventors: David Shattuck, Oak Park, CA (US); Richard Barter, Thousand Oaks, CA (US)

(73) Assignee: Sysco Guest Supply, Monmouth Junction, NJ (US)

( * ) Notice: Subject to any disclaimer, the term of this patent is extended or adjusted under 35 U.S.C. 154(b) by 878 days.

(21) Appl. No.: 13/013,027

(22) Filed: Jan. 25, 2011

(65) Prior Publication Data

US 2012/0186014 A1 Jul. 26, 2012

(51) Int. Cl.
*A47G 9/00* (2006.01)
*A47G 9/02* (2006.01)

(52) U.S. Cl.
CPC ..... *A47G 9/0223* (2013.01); *A47G 9/02* (2013.01); *A47G 9/0207* (2013.01); *A47G 9/0238* (2013.01); *A47G 9/0261* (2013.01); *A47G 9/0292* (2013.01)

(58) Field of Classification Search
CPC ..... A47G 9/00; A47G 9/02; A47G 9/0207; A47G 9/0223; A47G 9/0238; A47G 9/0292; A47G 9/04
USPC ..... 5/482, 485, 488, 493, 495, 498, 499, 5/500, 502
See application file for complete search history.

(56) References Cited

U.S. PATENT DOCUMENTS 708,109 A 9/1902 Williams
992,101 A 5/1911 Adams
1,267,042 A 5/1918 Arnold
1,844,291 A * 2/1932 Markutsis ..... 5/501
2,262,436 A 11/1941 Cotton
2,610,366 A 9/1952 Schworm, Jr.
2,799,870 A * 7/1957 Sullivan ..... 5/495
2,821,723 A * 2/1958 Gluck ..... 5/501
3,241,161 A 3/1966 Dashosh
3,273,176 A 9/1966 Millar (Continued)

FOREIGN PATENT DOCUMENTS

WO WO 91/19443 12/1991

OTHER PUBLICATIONS

Santos, Robert G., "First Office Action", U.S. Appl. No. 12/414,254, filed Mar. 30, 2009, Entitled "Bedding Cover with Integrated Runner," mailed Sep. 30, 2009.

(Continued)

*Primary Examiner* — Robert G Santos
*Assistant Examiner* — David E Sosnowski
(74) *Attorney, Agent, or Firm* — Philip H. Burrus, IV

(57) ABSTRACT

A mock duvet bed-covering system (1900) includes a blanket (1800) segmented into a plurality of portions and a coversheet (1810). The blanket (1800) includes a foot skirt flap (1804), a right side flap (1802), and a left side flap (1803) that each extend from a cover portion (1801) and are configured to drape over edges of a mattress (1880) or other bedding. The coversheet (1810) includes one or more pockets. A portion (1801) of the blanket (1800) opposite the foot skirt flap (1804) is tucked into a pocket (1811) at the head end of the coversheet (1810). The mock duvet bed-covering system (1900) resembles a traditional comforter and duvet, but is more durable and can be changed in far less time than traditional comforters, making the system well suited for use in hotels, inns, and the like.

17 Claims, 11 Drawing Sheets

(56) References Cited

U.S. PATENT DOCUMENTS

| | | | | |
|---|---|---|---|---|
| 4,021,869 | A | 5/1977 | Root | |
| 4,266,308 | A * | 5/1981 | Shatz | 5/494 |
| 4,312,285 | A | 1/1982 | Ketterer | |
| 4,384,381 | A | 5/1983 | Lowithan | |
| 4,802,250 | A * | 2/1989 | Farr | 5/482 |
| 4,903,360 | A | 2/1990 | Friedman | |
| D319,366 | S * | 8/1991 | Popovich et al. | D6/603 |
| 5,118,553 | A | 6/1992 | Boisson | |
| 5,240,758 | A | 8/1993 | Honigberg | |
| 5,321,861 | A | 6/1994 | Dancey et al. | |
| 5,513,403 | A | 5/1996 | Wooten, Jr. | |
| 5,713,089 | A | 2/1998 | Ferrante | |
| 5,836,023 | A | 11/1998 | Stone Munson | |
| 5,911,654 | A | 6/1999 | Webb | |
| 6,105,186 | A | 8/2000 | Stone Munson | |
| 6,122,781 | A * | 9/2000 | Stephenson | 5/482 |
| 6,148,458 | A | 11/2000 | Hires | |
| 6,237,171 | B1 | 5/2001 | Allen | |
| 6,496,992 | B2 * | 12/2002 | Saparow | 5/482 |
| 7,228,578 | B2 * | 6/2007 | Linnane | 5/485 |
| 7,316,039 | B2 | 1/2008 | Wootten, Jr. | |
| 7,530,124 | B1 | 5/2009 | Wootten, Jr. | |
| 7,562,404 | B2 | 7/2009 | Wootten, Jr. | |
| 7,565,707 | B2 | 7/2009 | Wootten, Jr. | |
| 2007/0000053 | A1 * | 1/2007 | Yang | 5/493 |
| 2007/0056099 | A1 * | 3/2007 | Langenberger | 5/493 |
| 2007/0151028 | A1 * | 7/2007 | Bauer | 5/482 |
| 2008/0295247 | A1 | 12/2008 | Rogers | |
| 2009/0113629 | A1 * | 5/2009 | Tucker | 5/485 |
| 2010/0050341 | A1 | 3/2010 | Tepper | |
| 2011/0016631 | A1 | 1/2011 | Stewart | |

OTHER PUBLICATIONS

Santos, Robert G., "Non-Final Office Action", U.S. Appl. No. 12/414,254, filed Mar. 30, 2009, mailed Sep. 14, 2010.

Santos, Robert G., "Final Office Action", U.S. Appl. No. 12/414,254, filed Mar. 30, 2009, mailed Mar. 31, 2010.

Santos, Robert G., "Final Office Action", U.S. Appl. No. 12/414,254, mailed Feb. 16, 2011.

Kelleher, William J., "Non-Final Office Action", U.S. Appl. No. 13/099,803, filed May 3, 2011, Mailed Sep. 2, 2011.

Kelleher, William J., "Final Office Action", U.S. Appl. No. 13/099,803, filed May 3, 2011; Mailed Dec. 5, 2011.

"Appeal Decision", U.S. Appl. No. 13/099,803, filed May 3, 2011; Mailed Dec. 31, 2014.

* cited by examiner

SEGMENTED QUILTED BLANKET AND CORRESPONDING MOCK DUVET COVER BED COVERING SYSTEM

BACKGROUND

1. Technical Field

This invention relates generally to a covering for a bed or mattress, and more particularly to a duvet-type cover for a mattress.

2. Background Art

Guests in hotels, inns, and beds and breakfasts enjoy luxurious accommodations. For example, guests may choose a particular hotel because it offers a more luxurious bathroom or higher quality furniture. Similarly, guests may prefer to stay in facilities offering higher quality linens or better mattresses. Generally speaking, hotel guests are demanding amenities that are less institutional and more like the comforts of home.

Along these lines, a guest may prefer to snuggle beneath a duvet filled with a plush goose down comforter over simply lying beneath a polyester bedspread. However, the use of comforters and duvets—instead of bedspreads—presents problems in a hotel environment. One such problem involves cleaning. It is far more time consuming to remove a comforter from a duvet, and then launder each, that it is to simply change a bedspread.

Another problem involves wear. Duvet covers in hotels receive extraordinary amounts of wear. One source of wear comes from hotel guests. For example, it is almost instinctive to some guests, at the moment of entering the room, to throw a suitcase or travel bag atop the bed covering. These bags and suitcases are often rough from being carried and generally cause mechanical wear to the covering. Additionally, bags and suitcases tend to be dirty and often stain or discolor the covering. Another source of wear comes from hotel staff. Frequently the covering must be ironed before it can be put back on a bed. Extensive washing, folding, ironing, and handling stresses the material of the covering.

There is thus a need for an improved bedding cover that is quicker and simpler to change, and that is easier to care for, yet that is aesthetically pleasing and as comfortable as traditional duvets and comforters.

Figure 1:
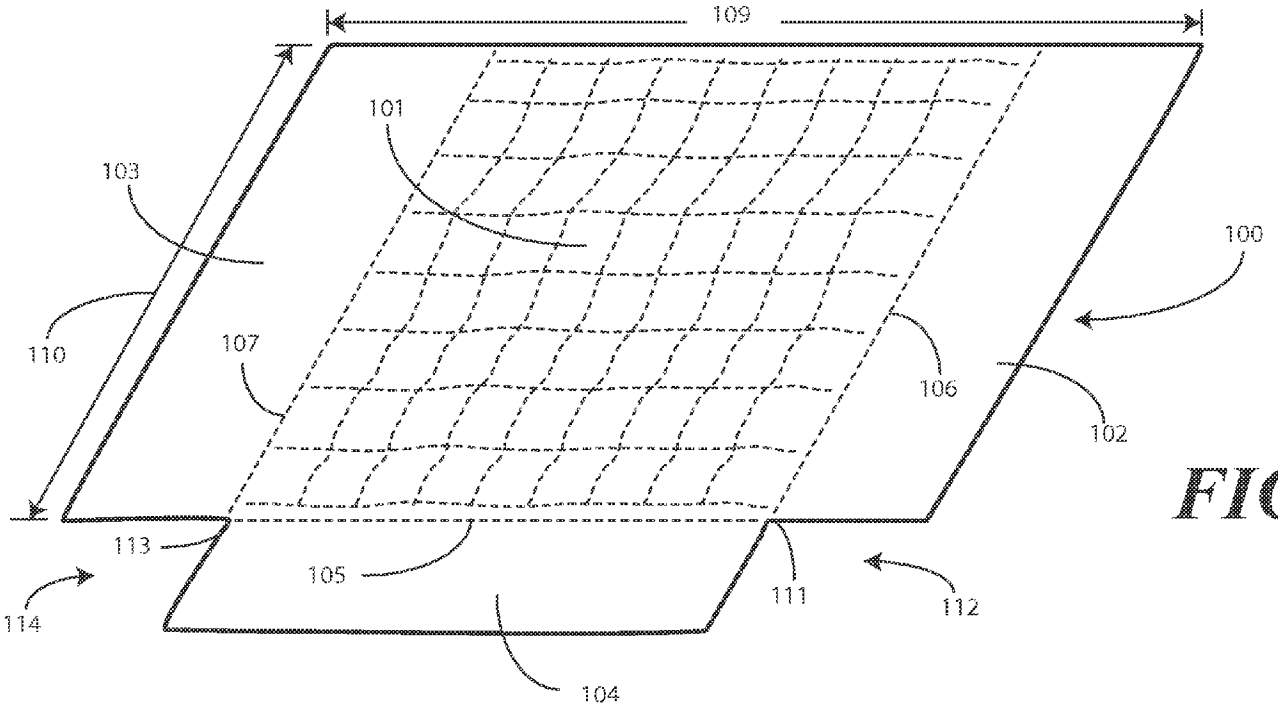
FIG. 1 illustrates one mattress cover configured in accordance with one or more embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Before describing in detail embodiments that are in accordance with the present invention, it should be observed that the embodiments reside primarily in combinations of method steps and apparatus components related to a mock duvet bed-covering system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

As noted above, many hotel guests prefer the comfort of a duvet and comforter to an ordinary bedspread. However, changing and laundering a comforter and duvet is quite a bit more time consuming. Experimental testing has shown it can take 400% longer to completely change bedding that includes a comforter and duvet that it does to change bedding employing a bedspread. As hotel staff may have to clean hundreds of rooms daily, this extra time can make the use of comforters and duvets cost prohibitive from a labor perspective.

Embodiments of the present invention provide a mock duvet bed-covering system that is configured to simulate a conventional duvet-comforter combination. However, the mock-duvet bed-covering systems described herein take a fraction of the time to change and launder than do their conventional counterparts. Further, embodiments described herein are more durable and can stand up to more wear and laundering than can, for example, a traditional goose down comforter inserted into a cotton duvet. While being more durable, embodiments described herein are every bit as aesthetically pleasing and comfortable as are their conventional counterparts.

Embodiments of the invention include a blanket and a coversheet. The blanket, which may be quilted, includes a cover portion configured to cover the top portion of a mattress and one or more flaps that are configured to drape over the sides of the mattress. In one embodiment, the flaps include a foot skirt flap, a right side flap, and a left side flap. While the flaps can form a continuous loop about the cover portion, in one embodiment substantially orthogonal voids are defined between the foot skirt flap and left side flap, and between the foot skirt flap and right side flap, respectively. These voids make it quicker and easier for a person to alight the blanket atop a mattress.

A coversheet is then provided to span across the top of the blanket. In one embodiment, the coversheet comprises a pocket into which a head portion, disposed opposite the foot skirt flap, may be tucked. When a bed is made with the head portion of the blanket tucked within the pocket, the system resembles a conventional duvet. Further, in one or more embodiments, a user may fold back the head portion of the system by thirty inches or more without revealing the fact that the system is made from two independent parts. Said differently, unless the user significantly folds back the head of the system, the user will not readily recognize the system as being anything other than a conventional duvet and comforter.

A person makes the bed with embodiments of the invention by first placing the blanket on a mattress. The blanket is generally placed atop a fitted and top sheet. The blanket can be quickly aligned via an interface line existing between the foot skirt flap in one or more embodiments and the foot edge of the mattress. The cover portion is then spread atop the planar surface of the mattress, allowing the flaps to drape over their respective edges. The flaps can then, optionally, be tucked if desired. The coversheet is then placed atop the blanket. In one embodiment, the coversheet is large enough so as to completely drape over each flap of the blanket. The head portion of the blanket is tucked into the pocket of the coversheet. The system is then spread evenly. The result is a durable, comfortable, and aesthetically pleasing system that resembles a conventional duvet and comforter, yet that takes only a quarter of the time to change.

Turning now to FIG. 1, illustrated therein is one mattress cover configured in accordance with one or more embodiments of the invention. Shown in FIG. 1 is a blanket 100 that is segmented into a plurality of portions. The illustrative blanket 100 of FIG. 1 includes a substantially rectangular cover portion 101, a foot skirt flap 104, a right side flap 102, and a left side flap 103. Each of the a foot skirt flap 104, a right side flap 102, and a left side flap 103 extend distally from a different edge of the substantially rectangular cover portion 101. Note that the term "substantially" is used to incorporate manufacturing and other tolerances associated with man-made textile articles. For instance, the "substantially rectangular" cover portion 101 may be slightly trapezoidal or rhomboidal, depending upon the capabilities of the manufacturer in creating orthogonal angles and other geometric shapes. Said differently, while a rectangular cover portion would have exactly ninety-degree corners, a real-world, substantially rectangular cover portion may have corners that are, for example, between eighty-eight and ninety-two degrees, depending upon tolerances.

The substantially rectangular cover portion 101 is configured to cover a top planar surface of a mattress. Accordingly, in one embodiment the surface area of the substantially rectangular cover portion 101 will substantially match the surface area of the top planar surface of a mattress. It will therefore be understood by those of ordinary skill in the art having the benefit of this disclosure that the substantially rectangular cover portion 101 could be sized to cover a twin mattress, a full mattress, a queen mattress, a king mattress, or other sized mattress. One illustrative dimensional specification for the substantially rectangular cover portion 101 is between fifty-eight and sixty-two inches in width 109, for example sixty inches, and between seventy-eight and eighty-two inches in length 110, such as eighty inches. In another illustrative embodiment, the dimensional specifications for the substantially rectangular cover portion 101 are between seventy and seventy-four inches in width 109, such as seventy-two inches, and between seventy-eight and eighty-two inches in length 110, such as eighty inches. It will be clear to those of ordinary skill in the art having the benefit of this disclosure that other dimensions can be used as well.

In one embodiment, the substantially rectangular cover portion 101 is quilted. The quilting can be manufactured in a variety of ways, using any of a variety of materials and a variety of techniques. One illustrative example will be described below with reference to FIG. 4. By way of example, the quilting can be formed by stuffing two layers of the substantially rectangular cover portion 101 with a suitable filling and then applying a double stitch with cording that is boxed end to end.

The foot skirt flap 104 extends distally from a first side 105 of the substantially rectangular cover portion 101. In one embodiment, the foot skirt flap 104 is configured to drape about a first side portion of a mattress when the substantially rectangular cover portion 101 is disposed atop the mattress. This will be shown in more detail in subsequent figures, including FIGS. 9 and 10.

The right side flap 102 extends distally from a second side 106 of the substantially rectangular cover portion 101. In one embodiment, the right side flap 102 is configured to drape about a second side portion of a mattress when the substantially rectangular cover portion 101 is disposed atop the mattress. As with the foot skirt flap 104, this will be shown in more detail in FIGS. 9 and 10. Similarly, the left side flap 103 extends distally from a third side 107 of the substantially rectangular cover portion 101. In one embodiment, the left side flap 103 is configured to drape about a third side portion of the mattress when the substantially rectangular cover portion 101 is disposed atop the mattress.

In one embodiment, the foot skirt flap 104, the right side flap 102, and the left side flap 103 are continuous and form a "U" shape about the first side 105, second side 106, and third side 107 of the substantially rectangular cover portion 101, respectively. In the illustrative embodiment of FIG. 1, the foot skirt flap 104, the right side flap 102, and the left side flap 103 are individual components and are discontinuous. Accordingly, each extends distally in a different direction from the substantially rectangular cover portion 101.

In this configuration, an interface 111 between the foot skirt flap 104 and the right side flap 102 defines a first substantially orthogonal void 112. This is shown in FIG. 1 as a square "cut out" formed between the foot skirt flap 104 and the right side flap 102. Similarly, an interface 113 between the foot skirt flap 104 and the left side flap 103 defines a second substantially orthogonal void 114. In one or more embodiments, the substantially orthogonal voids 112,114 are configured to close at the corners of a mattress when the various flaps drape about the edges. It is also well to note that the first side 105 of the substantially rectangular cover portion 101, which runs from an edge of the first substantially orthogonal void 112 to an edge of the second substantially orthogonal void 114 forms a visual alignment device suitable not only for aligning the blanket 100 along a mattress, but also for aligning the first substantially orthogonal void 112 and the second substantially orthogonal void 114 with the corners of the mattress.

The blanket 100 can be manufactured from any of a variety of materials, including polyester, cotton, rayon, silk, wool, and blends thereof. In one illustrative embodiment the blanket 100 is manufactured from 200-thread count, 55 percent cotton, 45 percent polyester material.

The various flaps can take any of a variety of dimensions. A few illustrative dimensions, which are suitable for use in hotel environments, are included here. It will be clear to those of ordinary skill in the art having the benefit of this disclosure that embodiments of the invention are not limited to these. Other dimensions could equally be used without departing from the spirit and scope of the invention.

In one illustrative embodiment, the foot skirt flap 104 extends from the first side 105 of the substantially rectangular cover portion 101 by a length of between sixteen and twenty inches, with an illustrative length being about eighteen inches. (The term "about" is used to include manufacturing tolerances as described above with reference to the term "substantially.") Experimental testing has shown that this length works well with many different mattress types. This length further allows the foot skirt flap 104 to optionally be tucked under a mattress as will be described in more detail below.

The right side flap 102 and left side flap 103 can also have any of a variety of dimensions. In one illustrative embodiment, the right side flap 102 and the left side flap each extend outwardly from the second side 106 and the third side 107, respectively by a common length. Experimental testing has shown that a length of between fourteen and sixteen inches, such as a length of about fifteen inches, is well suited for hotel applications.

When using the dimensions from the previous two paragraphs, the dimensions of the first substantially orthogonal void 112 and the second substantially orthogonal void 114 reveal themselves for an illustrative embodiment well suited to hotel applications. In such an embodiment, the first substantially orthogonal void 112 and the second substantially orthogonal void 114 have the same dimensions. Illustrative dimensions are between fourteen and sixteen inches in width, such as fifteen inches, and between sixteen and twenty inches in length, such as about eighteen inches.

Figure 2:
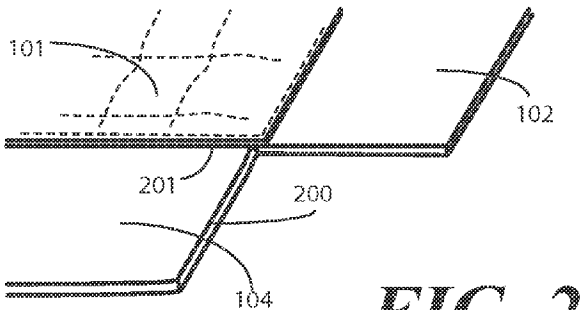
FIG. 2 illustrates one portion of a mattress cover having single-layer flaps in accordance with one or more embodiments of the invention.
Figure 3:
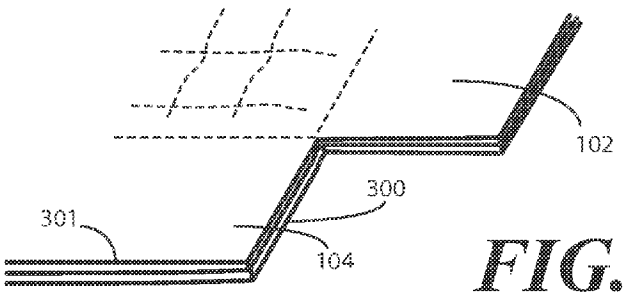
FIG. 3 illustrates one portion of a mattress cover having multi-layer flaps in accordance with one or more embodiments of the invention.

Turning now to FIGS. 2 and 3, the flaps and voids from the blanket (100) of FIG. 1 can more readily be seen. As shown in FIG. 2, in one embodiment the foot skirt flap 104 and the right side flap 102 (as well as the left side flap (103)) can be single-layer flaps. These flaps can extend from a single layer of material 200 that forms the bottom of the substantially rectangular cover portion 101. Where the substantially rectangular cover portion 101 is quilted, a second layer of material 201 can be sewn to the single layer of material 200 to form the quilting. The second layer of material 201 is confined only to be within a perimeter of the substantially rectangular cover portion 101, thereby leaving the flaps as single layers.

As shown in FIG. 3, in another embodiment the foot skirt flap 104 and the right side flap 102 (as well as the left side flap (103)) can be multi-layer flaps in that they are made from one or more layers of material 300,301. Additionally, the one or more layers of material 300,301 can be quilted if desired. Said differently, each and/or any of the foot skirt flap 104, the right side flap 102, and the left side flap (103) can be any of quilted, non-quilted, multi-layer, or single layer. In the illustrative embodiment of FIG. 3, the right side flap 102 and foot skirt flap 104 are shown as being unquilted, multi-layer flaps. These flaps can include a first layer of material 300 that forms the bottom of the substantially rectangular cover portion 101 and a second layer of material 301 can be sewn to the single layer of material 200 to form the quilting.

Figure 4:
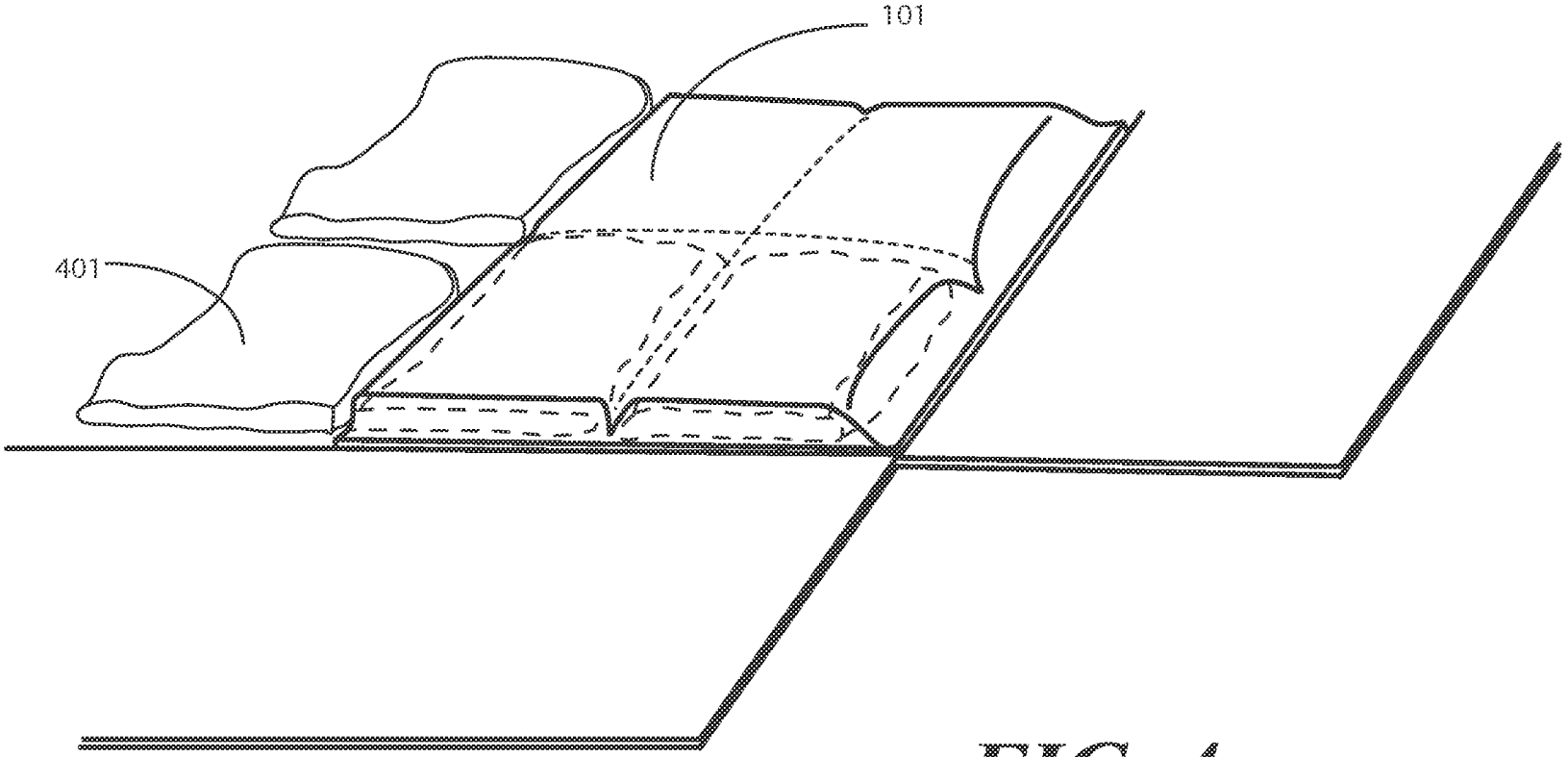
FIG. 4 illustrates quilting suitable for one or more portions of a mattress cover configured in accordance with one or more embodiments of the invention.

Turning now to FIG. 4, a cut-away view of the substantially rectangular cover portion 101 is shown. As noted above, in one or more embodiments, the substantially rectangular cover portion 101 can be quilted. In one illustrative embodiment, to enhance laundering ease and durability, the quilting comprises non-organic filler 404 capable of repeated machine washing. Experimental testing has shown that polyfill provides a suitable filler 404 capable of meeting these requirements. In one illustrative embodiment for example, the filler 404 of the quilting comprises six ounce per yard-squared polyfill. It will be clear to those of ordinary skill in the art having the benefit of this disclosure that other fillers can be used, including other petroleum-based fillers or even natural fillers. Embodiments of the invention work very well with natural fillers such as goose down, although laundering such fillers can be more time consuming.

Figure 5:
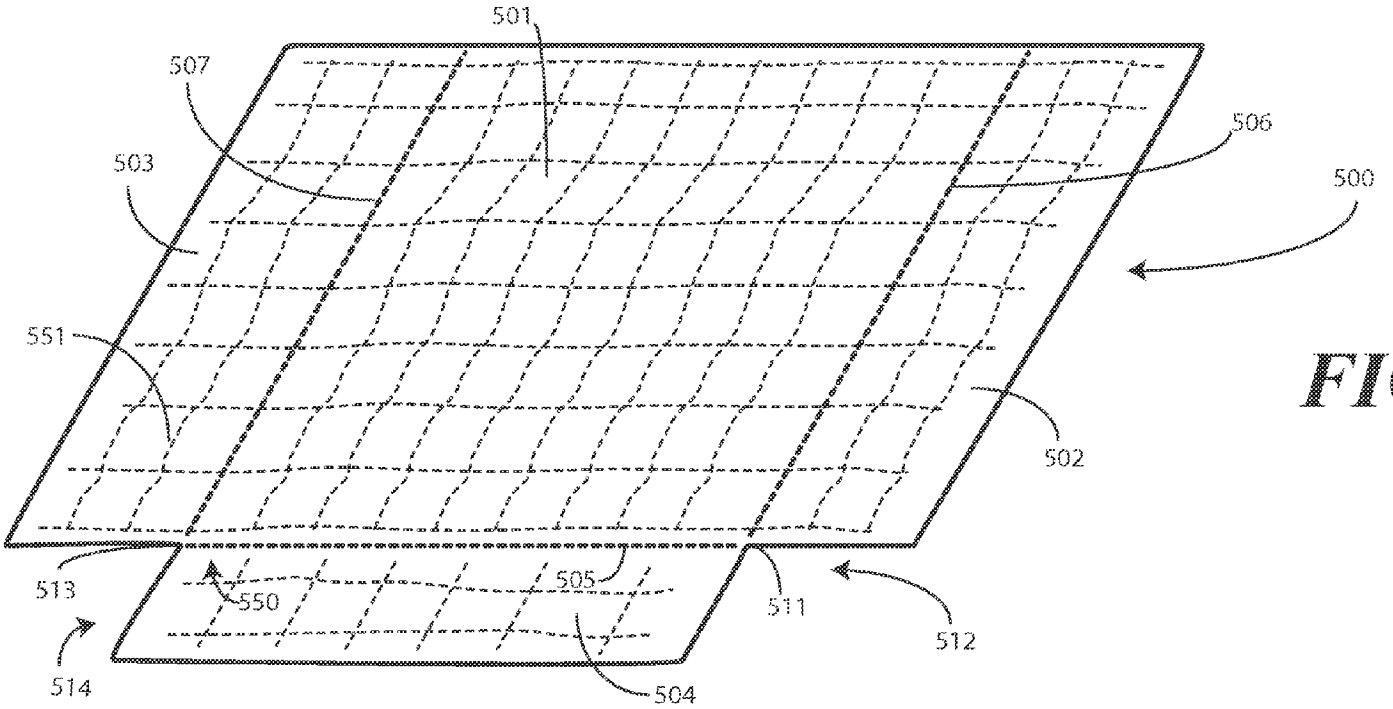
FIG. 5 illustrates one mattress cover configured in accordance with one or more embodiments of the invention.

Turning now to FIG. 5, illustrated therein is an alternate mattress cover configured in accordance with one or more embodiments of the invention. Shown in FIG. 5 is a blanket 500 that is segmented into a plurality of portions. As with the blanket (100) of FIG. 1, the illustrative blanket 500 of FIG. 5 includes a substantially rectangular cover portion 501, a foot skirt flap 504, a right side flap 502, and a left side flap 503. Each of the a foot skirt flap 504, a right side flap 502, and a left side flap 503 extend distally from a different edge of the substantially rectangular cover portion 501. As with the blanket (100) of FIG. 1, in FIG. 5 the substantially rectangular cover portion 501 is configured to cover a top planar surface of a mattress.

In the illustrative embodiment of FIG. 5, the substantially rectangular cover portion 501 and the various flaps are quilted. The foot skirt flap 504 is quilted, as are the right side flap 502 and the left side flap 503. Where one or more of the flaps are quilted, stitching 550 delineating the boundary between the substantially rectangular cover portion 501 and, for example, the foot skirt flap 504 can be configured to be visibly different from the stitching 551 forming the quilting.

As noted above, the first side 505 of the substantially rectangular cover portion 501 can be used as a visual alignment device. By configuring the stitching 550 to be different, the visual alignment device is more readily visible by a user.

The foot skirt flap 504 extends distally from a first side 505 of the substantially rectangular cover portion 501. In one embodiment, the foot skirt flap 504 is configured to drape about a first side portion of a mattress when the substantially rectangular cover portion 501 is disposed atop the mattress. In an alternate embodiment, the foot skirt flap 504 is configured to be tucked into a pocket of a cover sheet as will be described below.

The right side flap 502 extends distally from a second side 506 of the substantially rectangular cover portion 501. In one embodiment, the right side flap 502 is configured to drape about a second side portion of a mattress when the substantially rectangular cover portion 501 is disposed atop the mattress. In another embodiment, the right side flap 502 is configured to be tuckable into the pocket of a coversheet. Similarly, the left side flap 503 extends distally from a third side 507 of the substantially rectangular cover portion 501. In one embodiment, the left side flap 503 is configured to drape about a third side portion of the mattress when the substantially rectangular cover portion 501 is disposed atop the mattress. As with the other flaps, in one embodiment the left side flap 503 can be tucked into a pocket of a coversheet as well.

In the illustrative embodiment of FIG. 5, the foot skirt flap 504, the right side flap 502, and the left side flap 503 are individual components and are discontinuous. Accordingly, each extends distally in a different direction from the substantially rectangular cover portion 501. In this configuration, an interface 511 between the foot skirt flap 504 and the right side flap 502 defines a first substantially orthogonal void 512. This is shown in FIG. 5 as a square "cut out" formed between the foot skirt flap 504 and the right side flap 502. Similarly, an interface 513 between the foot skirt flap 504 and the left side flap 503 defines a second substantially orthogonal void 514. In one or more embodiments, the substantially orthogonal voids 512,514 are configured to close at the corners of a mattress when the various flaps drape about the edges. The flaps of FIG. 5 can have dimensions similar to those described with reference to FIG. 1, or can have other dimensions.

Figure 7:
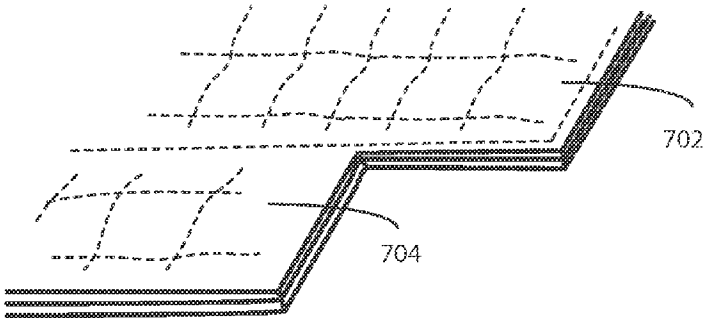
FIG. 7 illustrates one portion of a mattress cover having multi-layer flaps in accordance with one or more embodiments of the invention.
Figure 6:
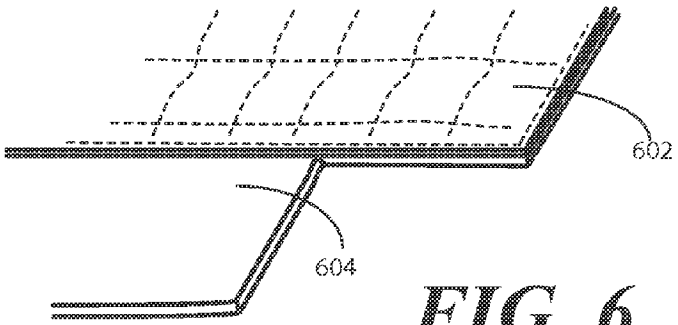
FIG. 6 illustrates one portion of a mattress cover having single-layer flaps in accordance with one or more embodiments of the invention.

Turning now to FIGS. 6 and 7, different configurations of the flaps and voids suitable for use with the blankets (100, 500) of FIGS. 1 and 5 are illustrated. As shown in FIG. 6, in one embodiment the foot skirt flap 604 is a single layer flap (as described above), while the right side flap 602 (as well as the corresponding left side flap) is a multi-layer, quilted flap. As shown in FIG. 7, in another embodiment both the foot skirt flap 704 and the right side flap 702 (as well as the corresponding left side flap) can be multi-layer, quilted flaps. Each flap can be single layer or multi-layer, quilted or unquilted, as an application dictates.

Figure 8:
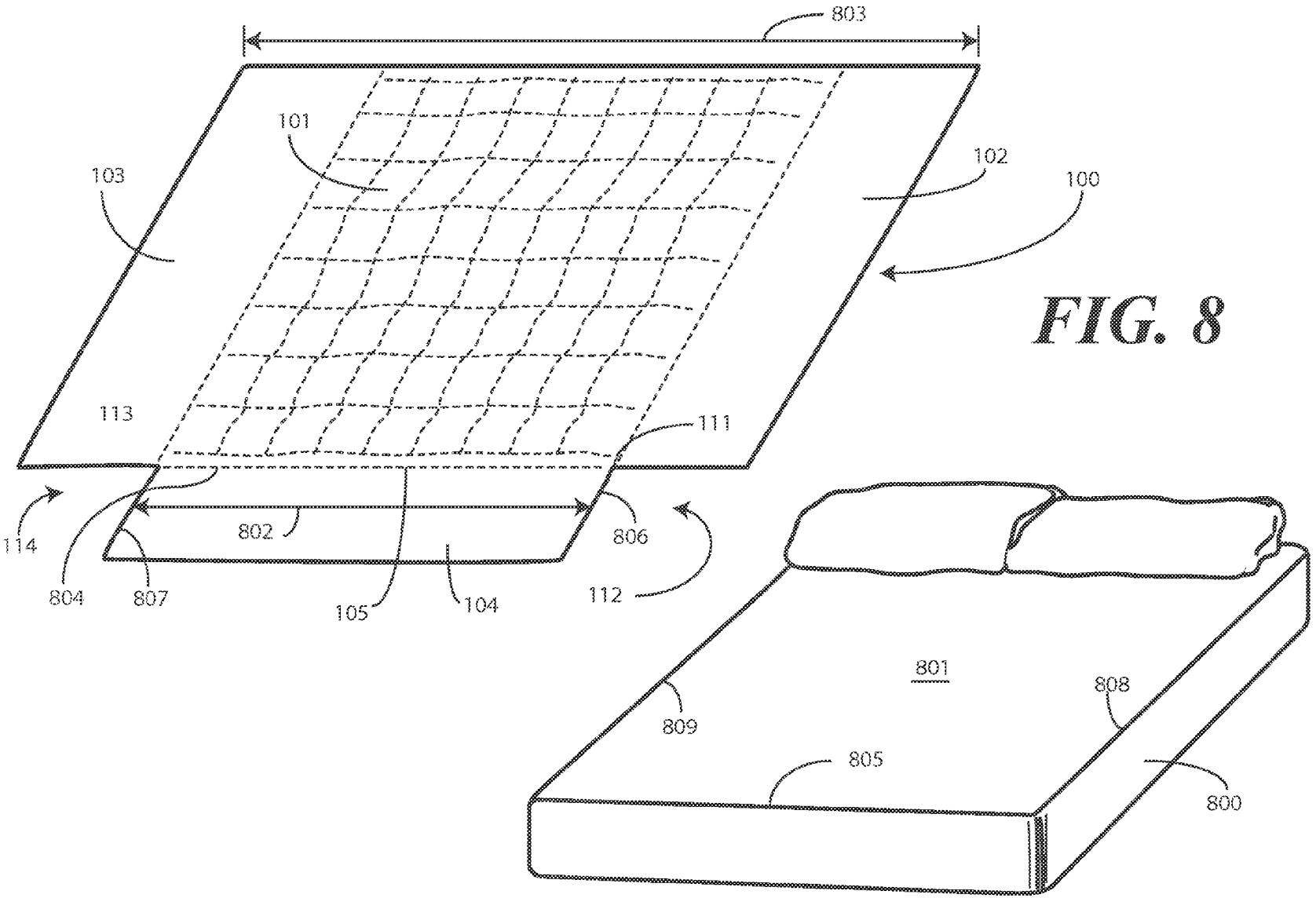
FIG. 8 illustrates one step in a method of making a bed in accordance with one or more embodiments and employing an illustrative mattress cover as described herein.

Turning now to FIG. 8, illustrated therein is one step in a method of applying a blanket 100 to a mattress 800 in accordance with one or more embodiments of the invention. As described above, the substantially rectangular cover portion 101, in one embodiment, is configured to substantially cover a top planar surface 801 of a mattress 800. As also described above, the first side 105 of the substantially rectangular cover portion 101 can be used as a visual indicator to quickly align the blanket 100 with the mattress 800.

In the initial step of making a bed in accordance with this illustrative embodiment, a user first procures the blanket 100. In the illustrative embodiment of FIG. 8, the blanket 100 includes a cover portion, e.g., substantially rectangular cover portion 101, that is configured to cover a top portion, e.g., substantially planar portion 801, of a mattress 800. The blanket 100 further includes a foot skirt flap 104 having a foot skirt flap width 802 that is less than the width 803 of the blanket 100. As described above, the interface 111 between the foot skirt flap 104 and the right side flap 102 defines a first substantially orthogonal void 112, while the interface 113 between the foot skirt flap 104 and the left side flap 103 defines a second substantially orthogonal void 114.

The next step of the method is to align an interface seam 804 disposed between the cover portion and the foot skirt flap 104 with an edge 805 of the mattress 800. The edges 806,807 of the foot skirt flap 104 can then be aligned with edges 808,809 of the mattress 800. As shown in FIG. 8, the edges 808,809 orthogonal with the first edge 805 of the mattress 800, and the edges 806,807 of the foot skirt flap 104 are correspondingly orthogonal with the interface seam 804.

The next step of the method is to spread the cover portion across the top of the mattress 800. When this is done, the foot skirt flap 104 drapes over the edge 805 of the mattress 800. Similarly, the right side flap 102 drapes over edge 808, and left side flap 103 drapes over edge 809. The result is shown in FIG. 9.

Figure 9:
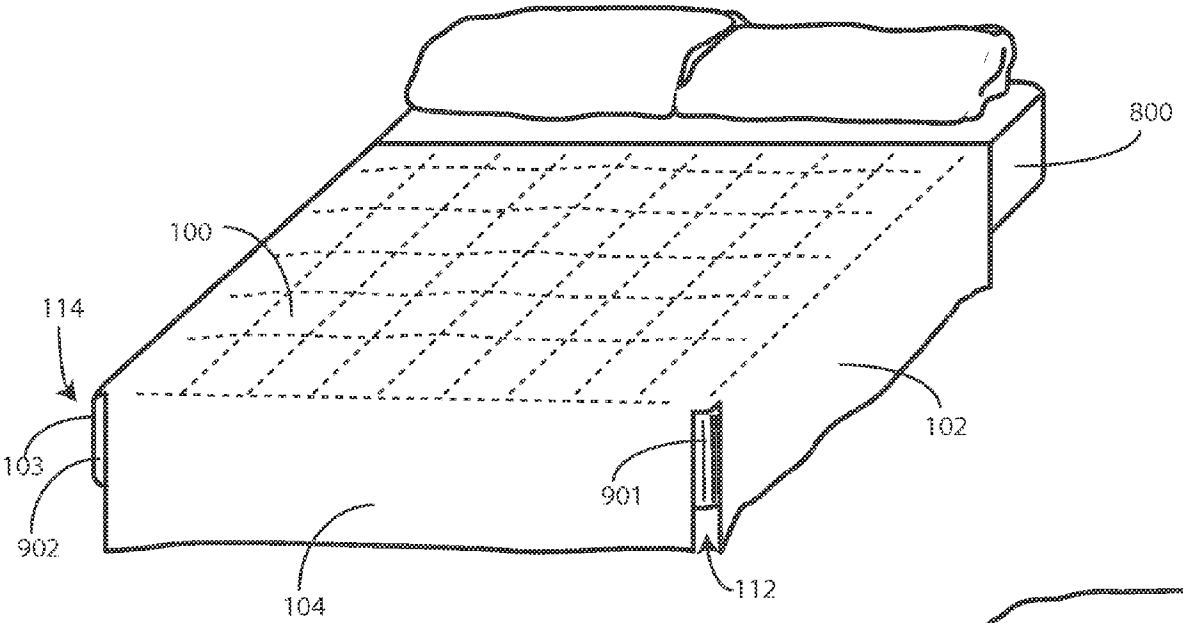
FIG. 9 illustrates another step in a method of making a bed in accordance with one or more embodiments and employing an illustrative mattress cover as described herein.

Turning to FIG. 9, the blanket 100 is shown with the foot skirt flap 104, right side flap 102, and left side flap 103 draped along the sides of the mattress 800. The first substantially orthogonal void 112 and the second substantially orthogonal void 114 have closed at the corners 901,902 of the mattress 900 due to the draping of the right side flap 102 over one of the edges (808) of the mattress 800 and the draping the left side flap (103) over another of the edges (809) of the mattress 800. In one embodiment, this completes a portion of the method.

Figure 10:
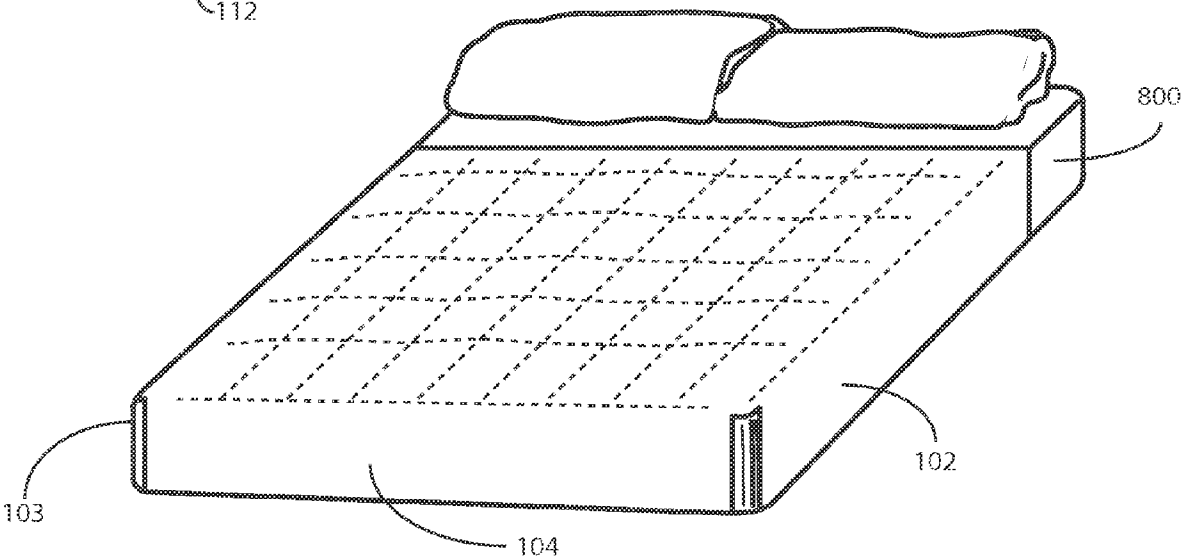
FIG. 10 illustrates another optional step in a method of making a bed in accordance with one or more embodiments and employing an illustrative mattress cover as described herein.

In another embodiment, one or more of the flaps can be tucked beneath the mattress 800 as shown in FIG. 10. Turning to FIG. 10, illustrated therein is the result of a method of making the bed where the method includes the described with reference to FIG. 8 and further includes the step of tucking at least the foot skirt flap 104 beneath the mattress 800. In the illustrative embodiment of FIG. 10, the right side flap 102 and left side flap 103 have been tucked beneath the mattress 800 as well, although this additional tucking is also optional. The result is a quickly applied, aesthetically pleasing bed covering.

Figure 11:
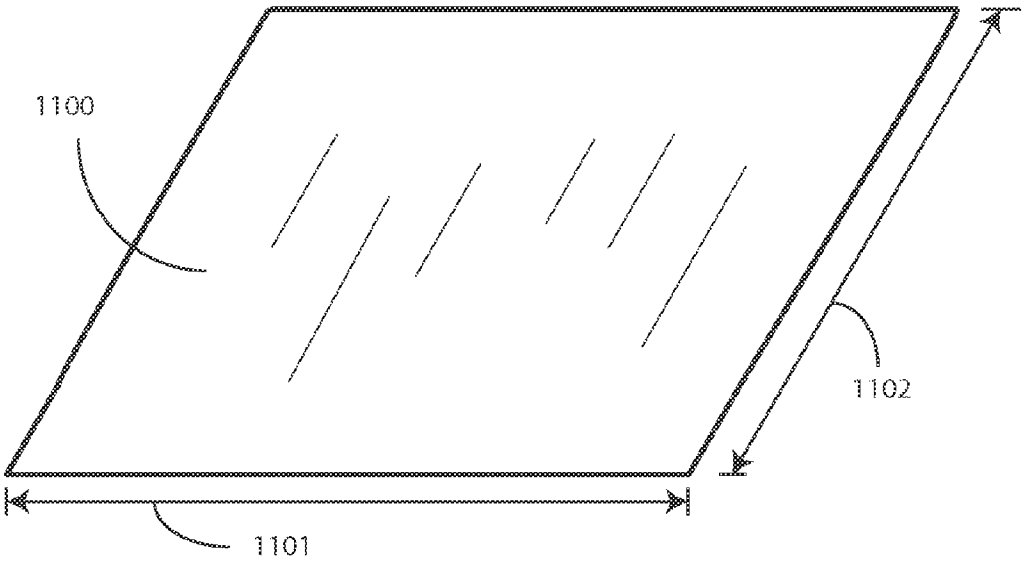
FIG. 11 illustrates a top perspective view of one coversheet configured in accordance with one or more embodiments of the invention.
Figure 12:
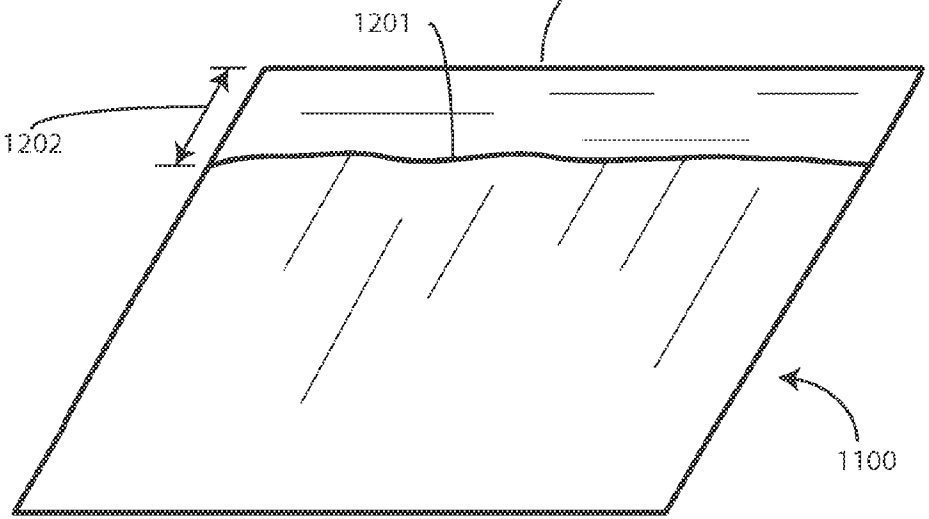
FIG. 12 illustrates a bottom perspective view of one coversheet configured in accordance with embodiments of the invention.

The covering in this configuration functions similar to a conventional comforter, in that the quilting provides both softness and warmth. To make the covering resemble a conventional duvet and comforter, in one embodiment a coversheet is used. Turning now to FIGS. 11 and 12, one embodiment of a coversheet 1100 is shown.

FIG. 11 shows a top perspective view of the coversheet 1100, while FIG. 12 shows a bottom perspective view of the coversheet 1100. The coversheet 1100 can be made from a variety of materials. The designer may select a particular material so as to make the coversheet 1100 resemble a particular type of duvet. In one illustrative embodiment, the coversheet 1100 is manufactured from 270-thread count polyester jacquard. Experimental testing has shown that this material is aesthetically pleasing in that it resembles a traditional duvet cover, but is also durable and can withstand the laundering rigors associated with hotel linens. The coversheet 1100 can include a "wear retardant," such as a stain protective coating or micro-poly coating along the fibers. The coversheet 1100 can be made from a single layer, or it can be made from a plurality of layers, such as with a top, ornamental layer of material and a lower, protective layer. For instance, where multiple layers are used, the top layer can be a decorative material such as one manufactured from cotton and polyester, while the lower layer can be a liquid resistant layer such as a nylon layer. The coversheet 1100 can be smooth or textured.

In one embodiment, the coversheet 1100 has dimensions that are sufficiently large that it can fully cover the blanket (100). Since the blanket (100) can be configured to accommodate different size mattresses, so too can the coversheet 1100. For example, it will be understood by those of ordinary skill in the art having the benefit of this disclosure that the coversheet 1100 can be configured to substantially cover a blanket (100) configured for twin mattress, a full mattress, a queen mattress, a king mattress, or other sized mattress. One illustrative dimensional specification for coversheet 1100 is a width 1101 of between eight-four and eighty-eight inches, such as eighty-six inches, and a length 1102 of between ninety-four and ninety-eight inches, such as ninety-six inches. In another illustrative embodiment, a dimensional specification for coversheet 1100 is a width 1101 of between ninety and ninety-four inches, such as ninety-two inches, and a length 1102 of between ninety-four and ninety-eight inches, such as ninety-six inches. In another illustrative embodiment, a dimensional specification for coversheet 1100 is a width 1101 of between one hundred and two and one hundred and six inches, such as one hundred and four inches, and a length 1102 of between ninety-four and ninety-eight inches, such as ninety-six inches. It will be clear to those of ordinary skill in the art having the benefit of this disclosure that other dimensions can be used as well.

In one embodiment, as shown in FIG. 12, the coversheet 1100 includes a pocket 1201 configured to receive a portion of the blanket (100) disposed opposite the foot skirt flap (104). In one embodiment, the pocket 1201 has a depth 1202 that is sufficient to maintain the illusion that the blanket (100) is a comforter disposed within a duvet when the top 1203 of the coversheet 1100 is partially folded back. However, the depth 1202 is shallow enough such that the portion of the blanket (100) disposed opposite the foot skirt flap (104) can be quickly inserted into the pocket 1201. In one illustrative embodiment, this depth 1202 less than a third of the length (1102) of the coversheet, which in one embodiment is also less than a third of the length of the blanket (100). In one embodiment, the depth 1202 is between twenty-eight and thirty-two inches, such as about thirty inches.

Figure 13:
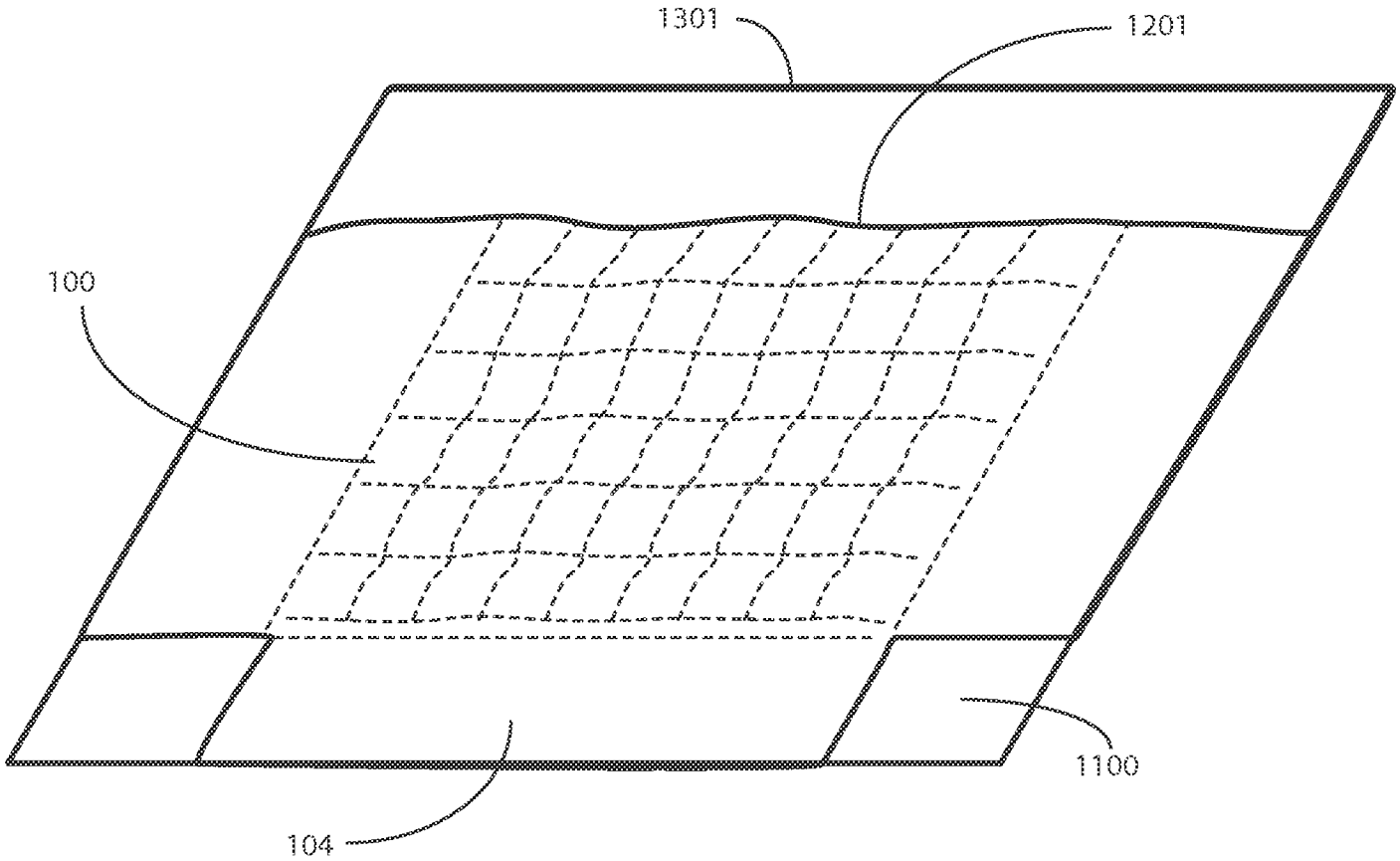
FIG. 13 illustrates a bottom perspective view of one illustrative mock duvet bed-covering system configured in accordance with one or more embodiments of the invention.

FIG. 13 illustrates the blanket 100 and coversheet 1100 in combination forming a mock duvet bed-covering system. Specifically, as shown, the portion of the blanket 100 opposite the foot skirt flap 104 has been inserted in the pocket 1201 of the coversheet 1100. This somewhat retains the blanket 100 and coversheet 1100 together. When the assembly is turned over, the combination of blanket 100 and coversheet 1100 resembles a conventional duvet and comforter. Further, so long as the user folds the head end 1301 down less than about thirty inches in this illustrative embodiment, the user will not notice that the blanket 100 and coversheet 1100 are separate components.

Figure 14:
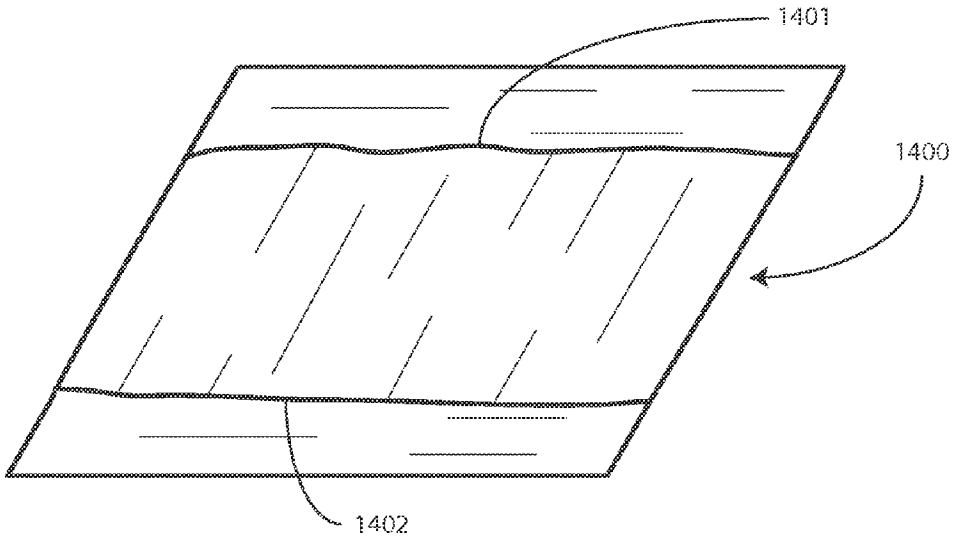
FIG. 14 illustrates a bottom perspective view of another coversheet configured in accordance with one or more embodiments of the invention.

It is well to note that while the coversheet 1100 of FIGS. 11, 12, and 13 includes one pocket 1201, coversheets can be configured with more pockets in accordance with one or more embodiments. For example, turning to FIG. 14, illustrated therein is a coversheet 1400 having two pockets 1401,1402. One pocket 1401 is at the head end of the coversheet and is configured to receive a portion of a blanket (100) disposed opposite the foot skirt flap (104). The second pocket 1402, disposed at the foot end, is configured to receive the foot skirt flap (104) itself. Two pockets can be advantageous, for example, where the foot skirt flap (104) is quilted. Further, the second pocket 1402 provides an additional retention mechanism between the coversheet 1400 and a blanket (100). In the illustrative embodiment of FIG. 14, the second pocket 1402 is between eighteen inches and twenty-two inches deep. An exemplary depth for the second pocket 1402 is about twenty inches.

Figure 15:
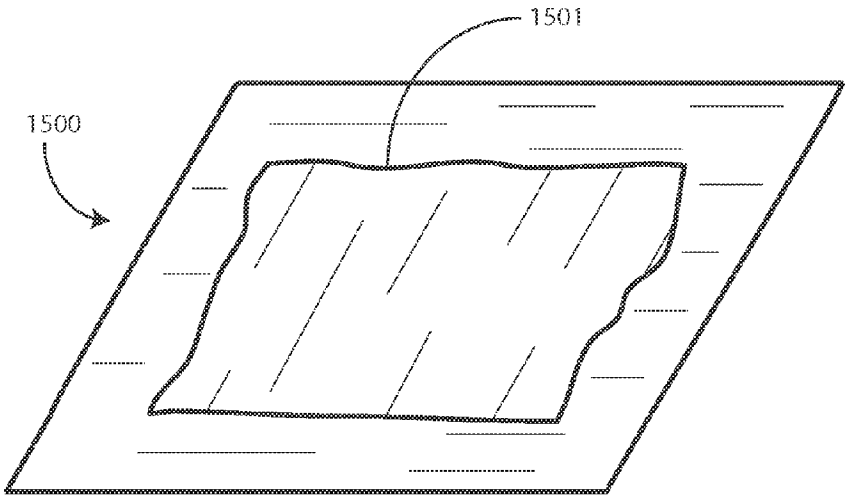
FIG. 15 illustrates a bottom perspective view of another coversheet configured in accordance with embodiments of the invention.

Turning to FIG. 15, illustrated therein is a coversheet 1500 comprising a four-sided, blanket-receiving pocket 1501 that spans each side of the coversheet 1500. This pocket 1501 permits not only the portion of the blanket (100) disposed opposite the foot skirt flap (104) to be tucked, but also the foot skirt flap (104), the right side flap (102), and the left side flap (103) as well. Said differently, this pocket 1501 defines a four-sided blanket opening disposed beneath the coversheet 1500.

Figure 16:
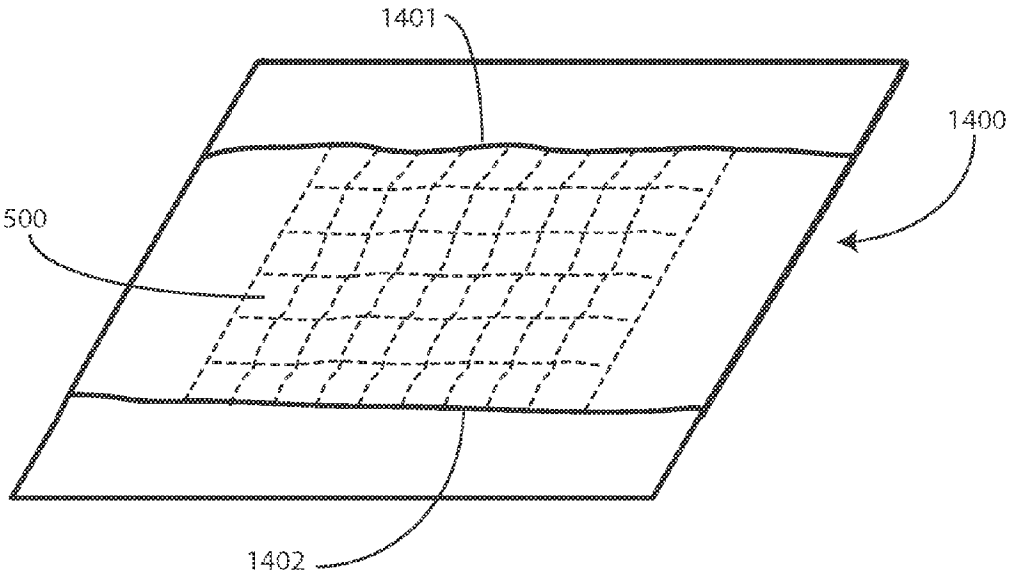
FIG. 16 illustrates a bottom perspective view of another illustrative mock duvet bed-covering system configured in accordance with one or more embodiments of the invention.

FIG. 16 illustrates a blanket 500 and the coversheet 1400 of FIG. 14 in combination forming a mock duvet bed-covering system. Specifically, as shown, the portion of the blanket 500 opposite the foot skirt flap (504) has been inserted into the pocket 1401 at the head end of the coversheet 1400. This provides an initial retaining member between the blanket 500 and coversheet 1500. The foot skirt flap (504) has likewise been inserted into the pocket 1402 at the foot end of the coversheet 1400. This provides a second retaining member between the blanket 500 and the coversheet 1400. When the assembly is turned over, the combination of blanket 500 and coversheet 1400 resembles a conventional duvet and comforter.

Figure 17:
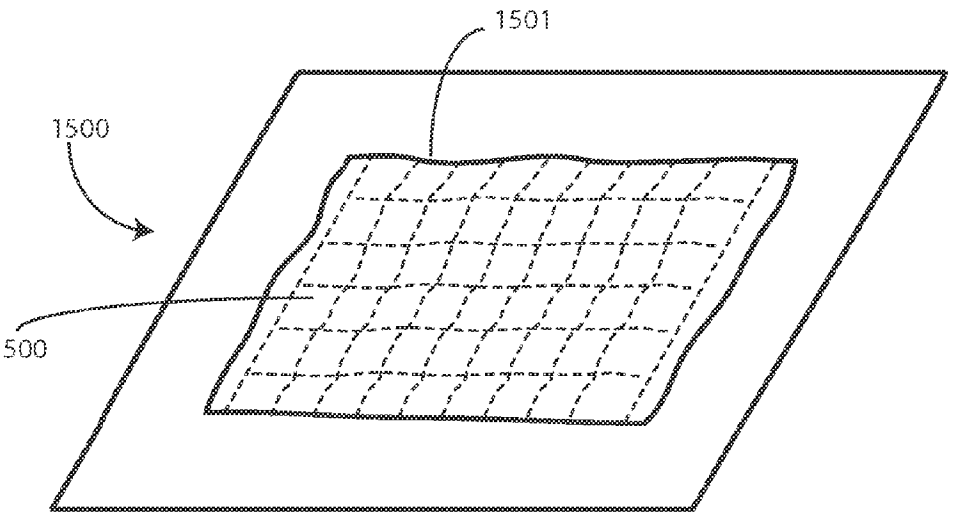
FIG. 17 illustrates a bottom perspective view of another illustrative mock duvet bed-covering system configured in accordance with one or more embodiments of the invention.

FIG. 17 illustrates a blanket 500 and the coversheet 1500 of FIG. 15 in combination forming a mock duvet bed-covering system. Specifically, as shown, the blanket 500 has been inserted into the pocket 1501 such that each flap is tucked within the blanket-receiving aperture defined by the four sides of the pocket 1501. When the assembly is turned over, the combination of blanket 500 and coversheet 1500 resembles a conventional duvet and comforter.

Figure 18:
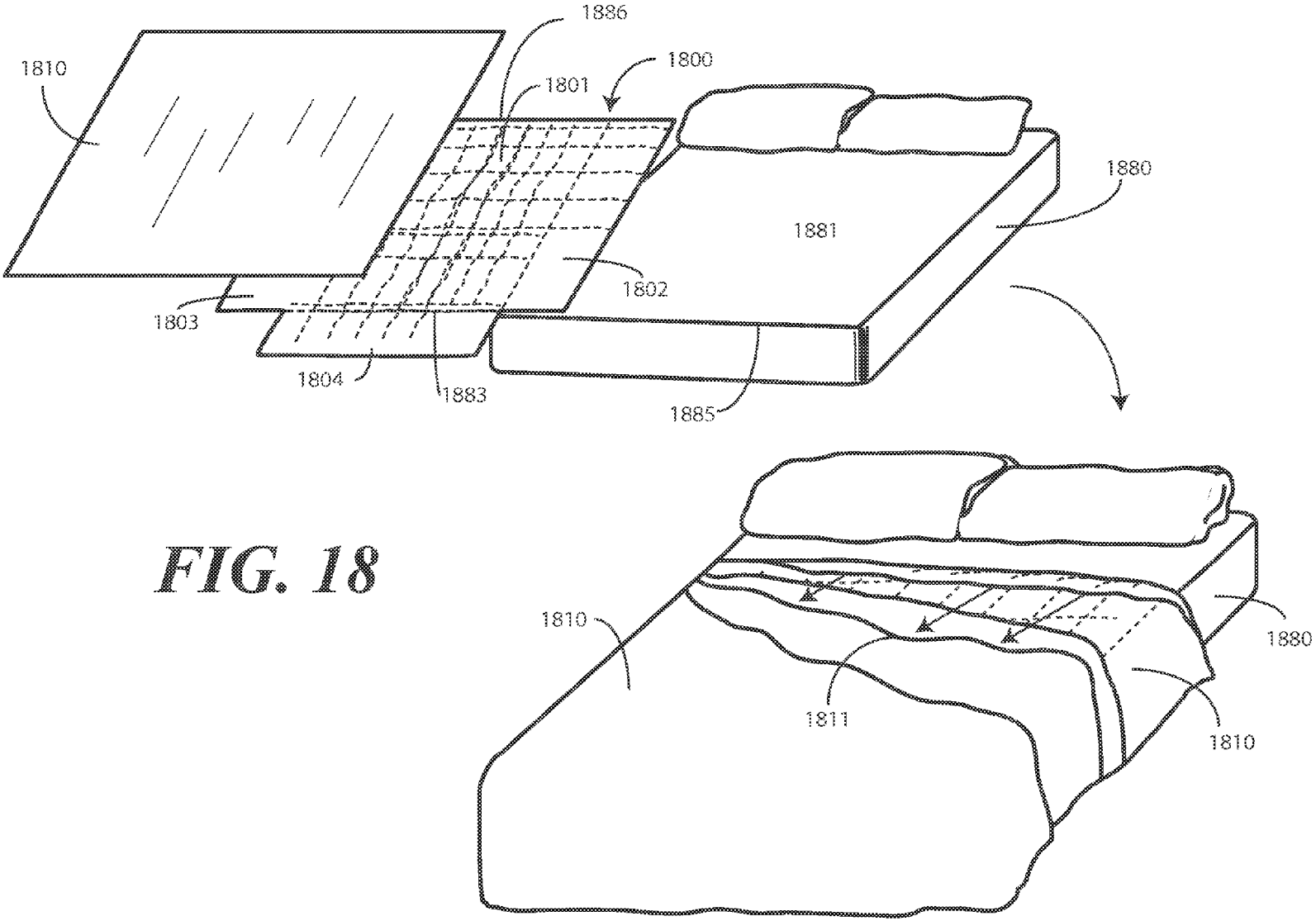
FIG. 18 illustrates a step of making a bed in accordance with one or more embodiments and employing an illustrative mock duvet bed-covering system configured in accordance with one or more embodiments of the invention.

Turning now to FIG. 18, illustrated therein are steps of a method of making a bed employing a mock duvet bed-covering system configured in accordance with one or more embodiments of the invention. The first steps of the method are similar to those described with reference to FIG. 8, which include obtaining a blanket 1800 that includes a cover portion 1801 configured to cover a top portion 1881 of a mattress 1880 and a foot skirt flap 1804 that has a foot skirt flap width that is less than the width of the blanket 1800. The foot skirt flap 1804, right side flap 1802, and left side flap 1803 can be quilted or non-quilted, and where non-quilted can be single layer or double layer.

The next step of the method is to align an interface seam 1883 disposed between the cover portion 1801 and the foot skirt flap 1804 with an edge 1885 of the mattress 1880. The next step of the method is to spread the cover portion across the top of the mattress 1880. When this is done, the foot skirt flap 1804 drapes over the edge 1885 of the mattress 1880.

The next step of the method involves obtaining a coversheet 1810 configured to cover the blanket 1800. The coversheet 1810 can be any of the coversheet (1100) of FIG. 11, the coversheet (1400) of FIG. 14, the cover sheet (1500) of FIG. 15, or another type of coversheet that includes one or more pockets disposed on the bottom side of the coversheet. In one embodiment, at least one pocket 1811 is configured to receive a portion 1886 of the blanket 1800 disposed opposite the foot skirt flap 1804. The next step is placing the coversheet 1810 on the mattress 1880 atop the blanket such that the pocket 1811 is beneath the coversheet 1810.

Figure 19:
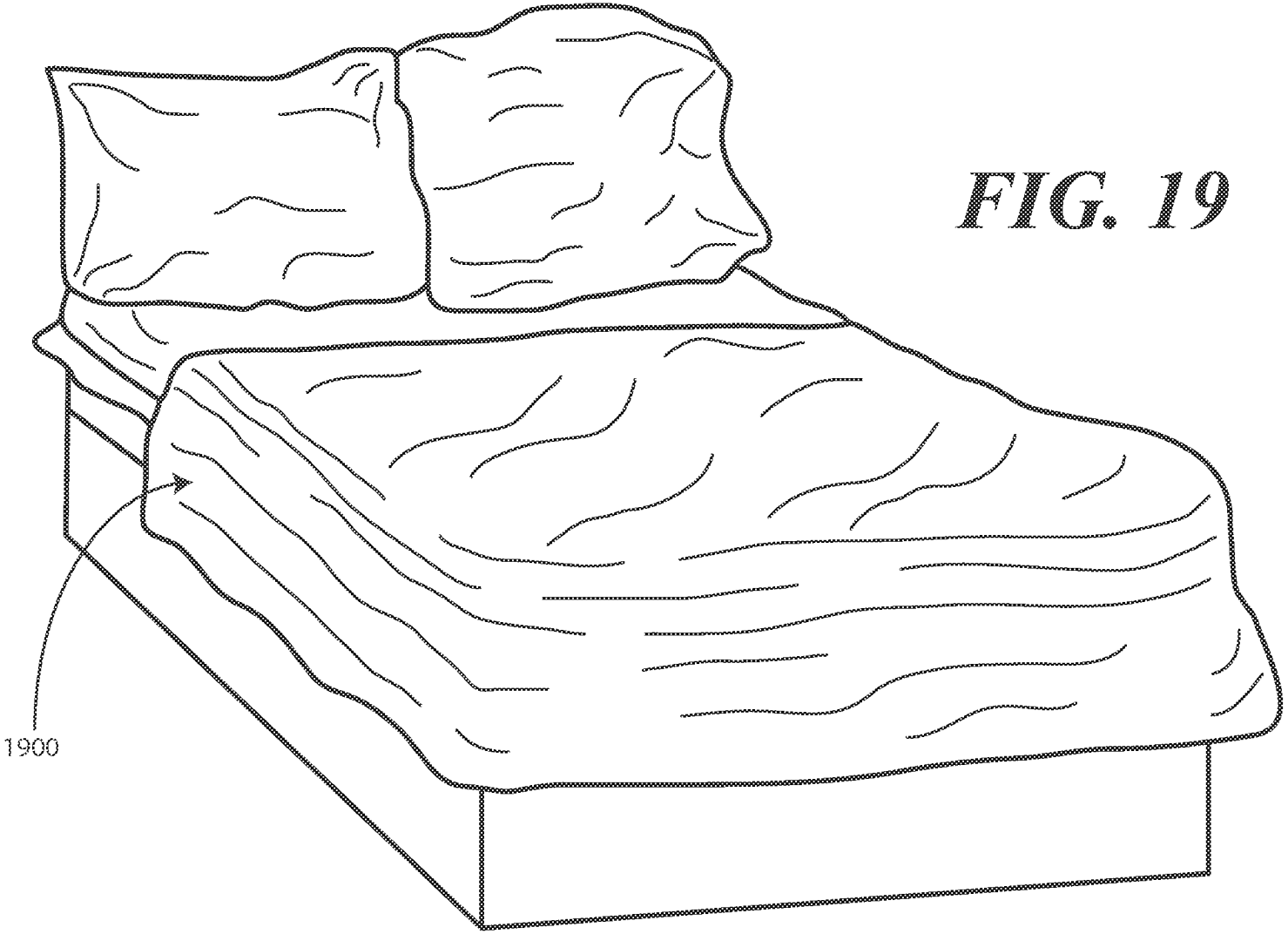
FIG. 19 illustrates a bed after completion of the steps shown in FIG. 18.

The next step in the method is to fold back the head end of the coversheet 1810 and then insert the portion 1886 of the blanket 1800 into the pocket 1811. Where multiple pockets exist, each side of the coversheet 1810 can be slightly folded back and the corresponding blanket portion inserted therein. The assembly can then be smoothed across the bed. The result, shown in FIG. 19, is a mock duvet bed-covering system 1900 that resembles a conventional duvet and comforter, but that can be completely changed in a quarter of the time. Further, the mock duvet bed-covering system is more durable and can withstand more laundering than can a traditional duvet and comforter. Additionally, as the pocket (1811) can be about thirty inches deep, presuming a sleeper folds down the head end of the mock duvet bed-covering system 1900 less than that amount, they will be unaware that it is a "mock" system, thinking instead they are sleeping under a traditional, cozy duvet and comforter.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A mattress cover, comprising:

a blanket segmented into a plurality of portions, the plurality of portions comprising:

a substantially rectangular cover portion configured to cover a top planar surface of a mattress;

a foot skirt flap extending from a first side of the substantially rectangular cover portion, wherein the foot skirt flap is configured to drape about a first side portion of the mattress when the substantially rectangular cover portion is disposed atop the top planar surface;

a right side flap extending from a second side of the substantially rectangular cover portion, wherein the right side flap is configured to drape about a second side portion of the mattress when the substantially rectangular cover portion is disposed atop the top planar surface; and a left side flap extending from a third side of the substantially rectangular cover portion, wherein the left side flap is configured to drape about a third side portion of the mattress when the substantially rectangular cover portion is disposed atop the top planar surface;

wherein an interface between the foot skirt flap and the right side flap defines a first substantially orthogonal void; and wherein another interface between the foot skirt flap and the left side flap defines a second substantially orthogonal void;

wherein the substantially rectangular cover portion is quilted and the foot skirt flap comprises one or more layers of unquilted material.

2. The mattress cover of claim 1, wherein the substantially rectangular cover portion is quilted with six ounce per yard squared polyfill.

3. The mattress cover of claim 1, wherein both the right side flap and the left side flap comprise one or more layers of the unquilted material.

4. The mattress cover of claim 3, wherein each of the foot skirt flap, the right side flap, and the left side flap comprise a single-layer fabric flap.

5. The mattress cover of claim 1, wherein the foot skirt flap extends from the first side between sixteen and twenty inches.

6. The mattress cover of claim 5, wherein both the first substantially orthogonal void and the second substantially orthogonal void each have a width of between fourteen and sixteen inches.

7. The mattress cover of claim 1, wherein the blanket is manufactured from 200-thread count, 55 percent cotton, 45 percent polyester material.

8. A mock duvet bed-covering system, comprising:

a blanket comprising a cover portion configured to cover a top portion of a mattress and a foot skirt flap configured to drape across a side of the mattress, wherein a foot skirt flap width is less than a width of the blanket; and a coversheet configured to cover the blanket, wherein the coversheet comprises a pocket configured to receive a portion of the blanket disposed opposite the foot skirt flap, wherein the pocket has a depth that is less than a third of a length of the blanket.

9. The system of claim 8, wherein the depth is about 30 inches.

10. The system of claim 8, wherein the coversheet comprises a second pocket configured to receive the foot skirt flap.

11. The system of claim 10, wherein the second pocket is about twenty inches deep.

12. The system of claim 8, wherein the pocket comprises a blanket-receiving pocket spanning each side of the coversheet and defining a four-sided blanket opening beneath the coversheet.

13. The system of claim 8, wherein the coversheet is manufactured from 270-thread count polyester jacquard.

14. The system of claim 8, wherein the blanket further comprises:

a right side flap configured to drape about a second side of the mattress; and a left side flap configured to drape about a third side of the mattress;

wherein an interface between the foot skirt flap and the right side flap defines a first substantially orthogonal void and another interface between the foot skirt flap and the left side flap defines a second substantially orthogonal void.

15. A method of making a bed, comprising:

obtaining a blanket comprising a cover portion configured to cover a top portion of a mattress and a foot skirt flap having a foot skirt flap width less than a width of the blanket;

aligning an interface seam between the cover portion and the foot skirt flap with an edge of the mattress;

aligning edges of the foot skirt flap with edges of the mattress, wherein the edges of the mattress are substantially orthogonal with the edge of the mattress;

spreading the cover portion across a top of the mattress;

draping the foot skirt flap over the edge of the mattress; and tucking the foot skirt flap beneath the mattress.

16. The method of claim 15, wherein the blanket further comprises:

a right side flap configured to drape about a second side of the mattress; and a left side flap configured to drape about a third side of the mattress;

wherein an interface between the foot skirt flap and the right side flap defines a first substantially orthogonal void and another interface between the foot skirt flap and the left side flap defines a second substantially orthogonal void;

wherein the method further comprises:

draping the right side flap over one of the edges of the mattress and draping the left side flap over another of the edges of the mattress, thereby causing the first substantially orthogonal void and the second substantially orthogonal void to close at corners of the mattress.

17. The method of claim 15, further comprising:

obtaining a coversheet configured to cover the blanket, wherein the coversheet comprises a pocket configured to receive a portion of the blanket disposed opposite the foot skirt flap; and placing the coversheet on the mattress such that the pocket is beneath the coversheet; and inserting the portion of the blanket into the pocket.

* * * * *